US009492003B2

(12) United States Patent
Patel

(10) Patent No.: US 9,492,003 B2
(45) Date of Patent: Nov. 15, 2016

(54) MULTI-PURPOSE CONVERTIBLE BACKPACK SYSTEM—FLIPPER BAG

(71) Applicant: Hiren Patel, McDonough, GA (US)

(72) Inventor: Hiren Patel, McDonough, GA (US)

(73) Assignee: Hiren Patel, McDonough, GA (US)

( * ) Notice: Subject to any disclaimer, the term of this patent is extended or adjusted under 35 U.S.C. 154(b) by 252 days.

(21) Appl. No.: 14/335,082

(22) Filed: Jul. 18, 2014

(65) Prior Publication Data

US 2016/0015155 A1 Jan. 21, 2016

(51) Int. Cl.

| | |
|---|---|
| ***A45F 3/04*** | (2006.01) |
| ***A44B 19/38*** | (2006.01) |
| ***A47C 31/10*** | (2006.01) |
| ***A45C 9/00*** | (2006.01) |

(52) U.S. Cl.

CPC ..... *A45F 3/04* (2013.01); *A44B 19/382* (2013.01); *A45C 9/00* (2013.01); *A47C 31/105* (2013.01); *A45C 2009/007* (2013.01); *Y10T 24/25* (2015.01); *Y10T 24/2516* (2015.01); *Y10T 24/2534* (2015.01); *Y10T 24/2593* (2015.01)

(58) Field of Classification Search

CPC ..... A45F 2004/003; A45C 7/0063; A45C 7/0068; A45C 7/0072

USPC ..... 224/578, 579, 581; 190/130–105

See application file for complete search history.

(56) References Cited

U.S. PATENT DOCUMENTS

| | | | | | |
|---|---|---|---|---|---|
| 4,153,146 | A * | 5/1979 | Patton | A45C 7/0068 | 190/103 |
| 4,810,102 | A * | 3/1989 | Norton | A45C 1/04 | 150/108 |
| 5,628,093 | A * | 5/1997 | Goodale | A44B 19/382 | 24/381 |
| 5,964,384 | A * | 10/1999 | Young | A45C 7/0063 | 190/103 |
| 6,092,702 | A * | 7/2000 | Cassidy, IV | A45C 7/0063 | 224/153 |
| 6,460,746 | B1 * | 10/2002 | Amram | A45F 3/047 | 224/579 |
| 7,178,567 | B2 * | 2/2007 | Mangano | A45C 7/0072 | 150/103 |
| 7,828,027 | B2 * | 11/2010 | Mangano | A45C 3/06 | 150/100 |
| 8,281,970 | B2 * | 10/2012 | Demskey | A45F 3/14 | 224/579 |
| 8,534,523 | B2 * | 9/2013 | Murdoch | A45F 3/04 | 224/581 |
| 2003/0024960 | A1 * | 2/2003 | Greenstein | A45C 11/20 | 224/153 |

(Continued)

*Primary Examiner* — Sarah McPartlin

(57) ABSTRACT

A multi-purpose backpack style bag also referred as Flipper bag herein that can be used alternatively as a backpack, a handbag, or a shoulder bag. Moreover, the Flipper bag can also be converted from the backpack into a handbag without removing the contents of the handbag. The Flipper bag is made of two components, the top flipper body that is reversible, and the bottom handbag body. The bottom handbag body can be independently used as a handbag or a shoulder bag. When the top flipper body is combined with the bottom handbag body, it can be used as a backpack style bag; or the user can fold down the top flipper body over the bottom handbag body so it covers the bottom handbag body and close the flipper cover to use it as a different design of handbag.

11 Claims, 10 Drawing Sheets

(56) References Cited

U.S. PATENT DOCUMENTS

2007/0137959 A1* 6/2007 Zauderer ..... A45C 3/08
190/110

* cited by examiner

MULTI-PURPOSE CONVERTIBLE BACKPACK SYSTEM—FLIPPER BAG

BACKGROUND OF THE INVENTION

This present invention relates to backpack systems and handbags. More particularly, the invention relates to converting a backpack system into a handbag. For example, a backpack system designed specifically for men with sporty look can be converted in to a women handbag with a different women oriented look with a touch of pink color or vice versa. The invention also relates to converting the handbag into a different material or color handbag again without removing the contents of the handbag.

While there are number of handbags that can be converted into a backpack, there's a desired need to extend a handbag into a backpack without removing the content of the handbag; and adding more space for additional storage in the extended portion of the backpack.

Most travelers, specifically women desire to take multiple different handbags. Though, it would be very inconvenient to carry two handbags and a backpack while travelling. In these situations, it would be ideal if the traveler can take just one complete backpack system and convert it to a handbag, and again into a different material or color handbag or extend it back to a backpack for more storage.

When travelling, it would be ideal for women to carry one handbag that can be converted into a different material or color combination that matches appropriately with the clothing. Often times, when travelling women also need additional storage and it would be ideal if the same handbag can be extended for more storage and can be carried as a backpack.

SUMMARY OF THE INVENTION

The Flipper Bag of the present invention includes two similar sizes of bag bodies.

The bottom body component also referenced as a handbag is a complete handbag for normal use as a handbag or a shoulder bag. The top flipper body component also referenced, as a flipper may not be used by itself. Both the inner and outer sides of the flipper body are differently finished designs. The top portion of the flipper body may be opened or closed using a zipper or any other fastener system. The bottom portion of the flipper body is open.

On the inner side close to the opening of the bottom body, sewed is the right side of a zipper. At the bottom part of the flipper body, sewed is the left side of a zipper. The left side and the right side of the zipper attached to the top flipper body and the bottom handbag body respectively in that order can be zipped together when extending the handbag into the backpack mode.

When the flipper body is zipped to the handbag and is in the backpack mode, the flipper may be folded downwards after opening from top to cover the handbag and closed at the bottom of the handbag. By folding down the flipper body downwards over the handbag material, the backpack may be converted into a handbag with a different design to present the inner side of the flipper body.

BRIEF DESCRIPTION OF THE DRAWINGS

Various embodiments of the invention are disclosed in the following detailed description and accompanying drawings.

DETAILED DESCRIPTION OF THE PREFERRED EMBODIMENTS

Figure 1:
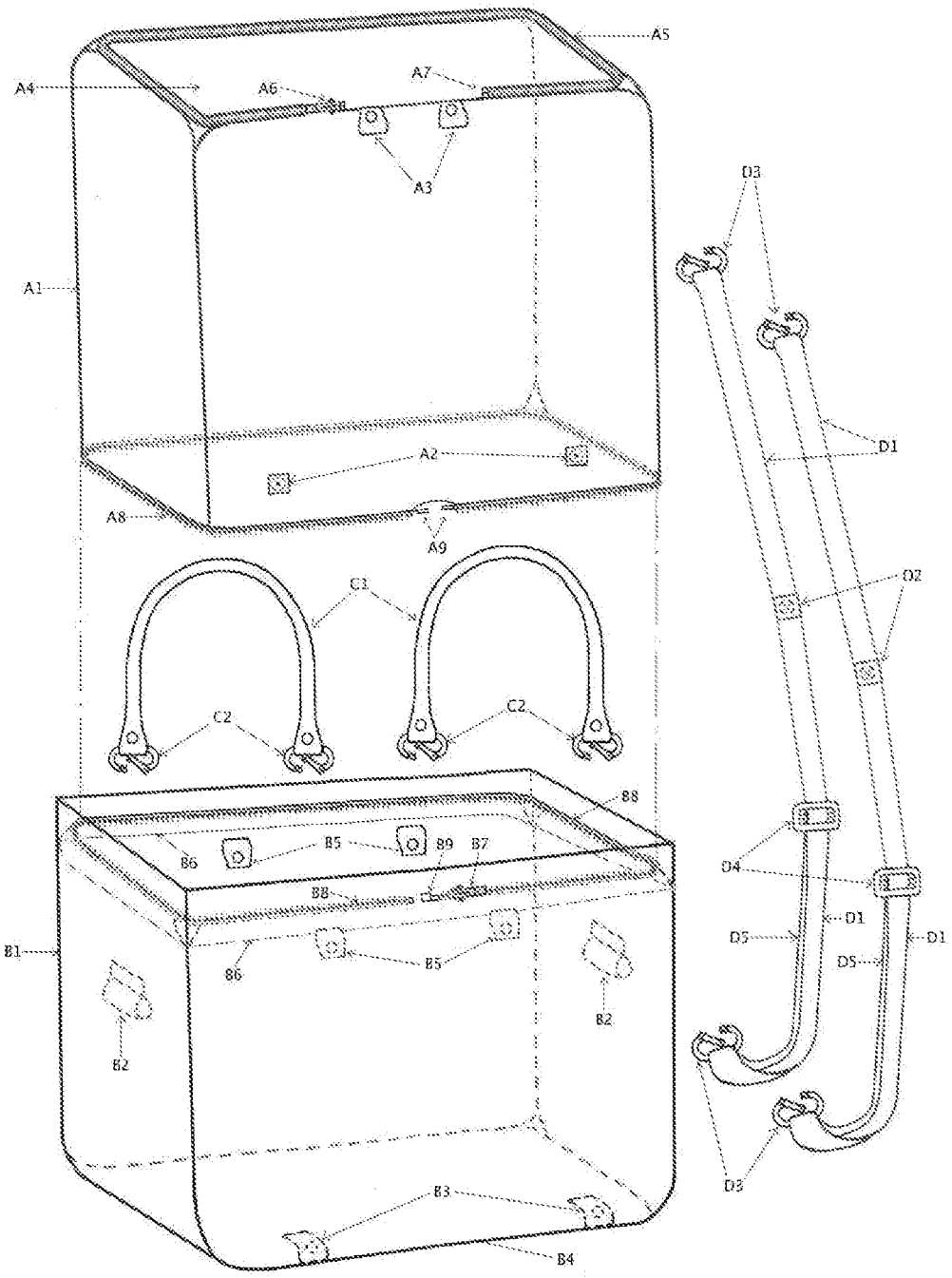
FIG. 1 is a perspective view of all of the separate components of the present invention, the top flipper body component, the bottom handbag body component, the handbag handles, and the back shoulder straps, which are all combinable with each other.

It is understood that only certain illustrated embodiments or implementations are shown in the drawings and will be described in details, but it is possible that various modifications, alternative constructions, and alternative techniques may be applied to the present invention within the scope as defined in the claims. The purpose is to include or cover all of the various modifications, alternative constructions, alternative techniques, and equivalents falling within the scope of the present invention as defined in the claims.

In the following description and in the figures, like elements are identified with like reference numerals. The use of "e.g.," "etc.," and "or" indicates non-exclusive alternatives without limitation, unless otherwise noted. The use of "including" means "including, but not limited to," unless otherwise noted.

The convertible backpack system of the present invention is shown in FIG. 1-8. FIG. 1 shows the various components separately that may be combined together to make the convertible backpack system of the present invention. FIG. 1 also shows the top flipper body component designated as A1, the bottom handbag body component as B1, the handbag handles designated as C1, and the back shoulder straps designated as D1.

The zipper made up of components designated as A8 and B8 as illustrated in FIG. 1 is the mechanism or the technique to combine components A1 and B1 together. The zipper components A9 and B9 can be used in conjunction with B7 to close the zipper components A8 and B8 to combine the backpack system together. Also, both ends of the zipper chain half (A8) as shown in FIG. 1 will have zipper pin, this way the flipper body A1 can be reversed and the reversible zipper chain half A8 can still be joined with zipper chain other half B8 using the Zipper Pin A9 to Zipper Box B9.

It should be noted that the top flipper body A1 and the handbag body B1 as shown in FIG. 1 can also be attached or combined by an alternative mechanism using two separate zipper chains attached to the Flipper body A1 so that one zipper chain is inside and the other is outside. Moreover, the flipper body can be attached or combined by using two separate zippers all together so that flipper body A1 can be reversed and attached to bottom handbag body B1. The same can be achieved using a two-way separating zipper as well. Also, the flipper body A1 and handbag body B1 as shown in FIG. 1 can be attached or combined with any other alternative mechanism using any other type of fastener system.

Figure 2A:
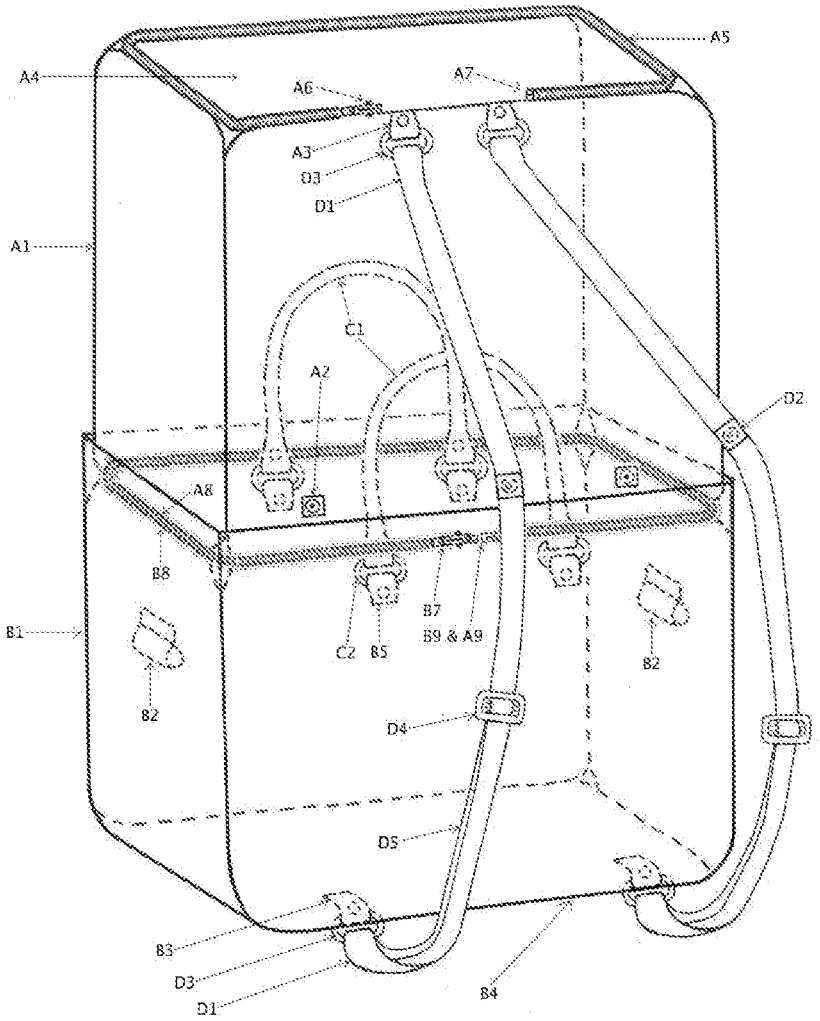
FIG. 2A is a complete perspective view of the one embodiment of the backpack system of the present invention; dotted lines showing the inside components that are not visible from outside the backpack system.

The handbag handles designated as C1 in FIG. 1 can be combined or attached with B5 of the bottom handbag body designated as B1, by using the buckles designated as C2 but not limited to the buckles shown as C2 but any type of buckles. As shown in FIG. 2A, four buckles (C2) will be required to attach or combine the handles to the handbag B1. Also, as shown in FIG. 2A the handbag handles will be attached or combined from inside the handbag B1 by using four buckles (C2) attaching or connecting to B5. Buckle holder B5 can also be attached to the flipper body so that when converted into a handbag, the handbag handles can be attached from outside.

Figure 2B:
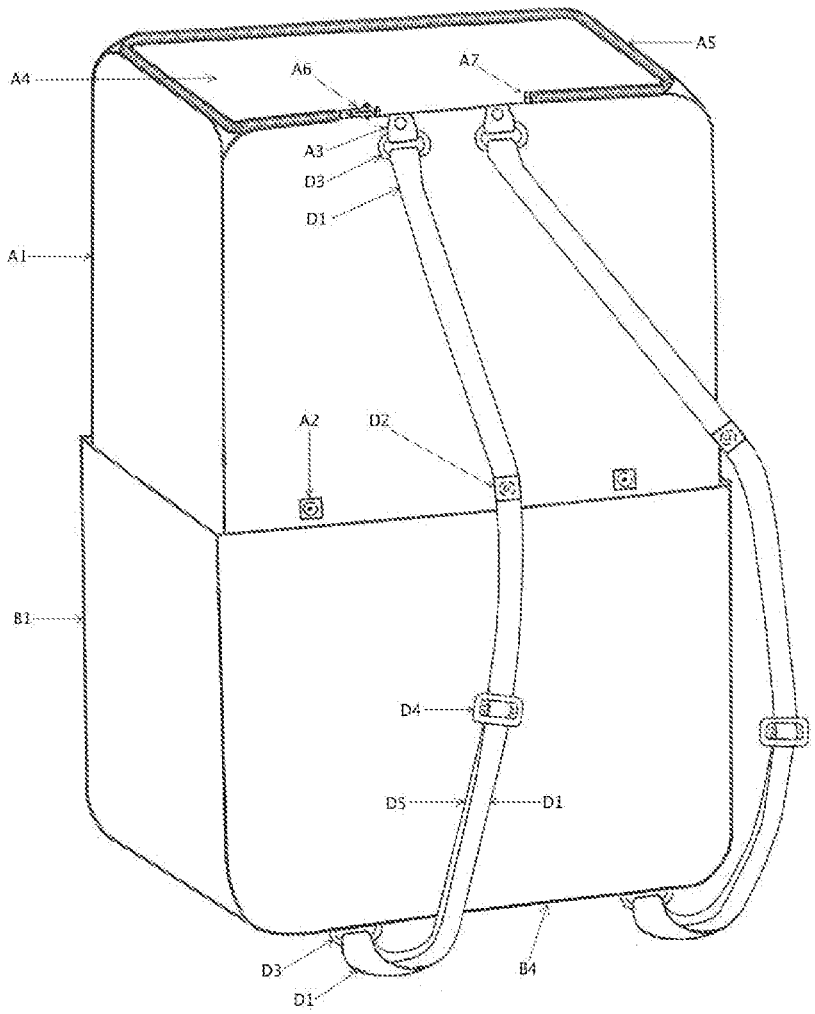
FIG. 2B is a perspective view of the one embodiment of the backpack system of the present invention.

The back shoulder straps designated as D1 in FIG. 1 can be combined or attached with the backpack system, top end of the strap D1 can be attached to A3 and bottom end of the strap D1 can be attached to B3 as shown in FIGS. 2A and 2B by using the buckles D3. Four buckles (D3) can be used to attach or combine the back shoulder straps with the backpack system as shown in FIGS. 2A and 2B. The back shoulder straps designated as D1 in FIG. 1 can be combined or attached to the buckle holder designated as B2 on both sides using two buckles (D3) of the handbag to use to carry the handbag as a shoulder bag.

FIG. 2A and FIG. 2B shows the complete convertible backpack system of the present invention, showing all of the various components combined together to make up the complete backpack system. As shown in FIG. 2A, the flipper body component 1A is combined with the handbag body component 1B by the means of zipper components (A8, B8, A9, B9, and B7).

Figure 3A:
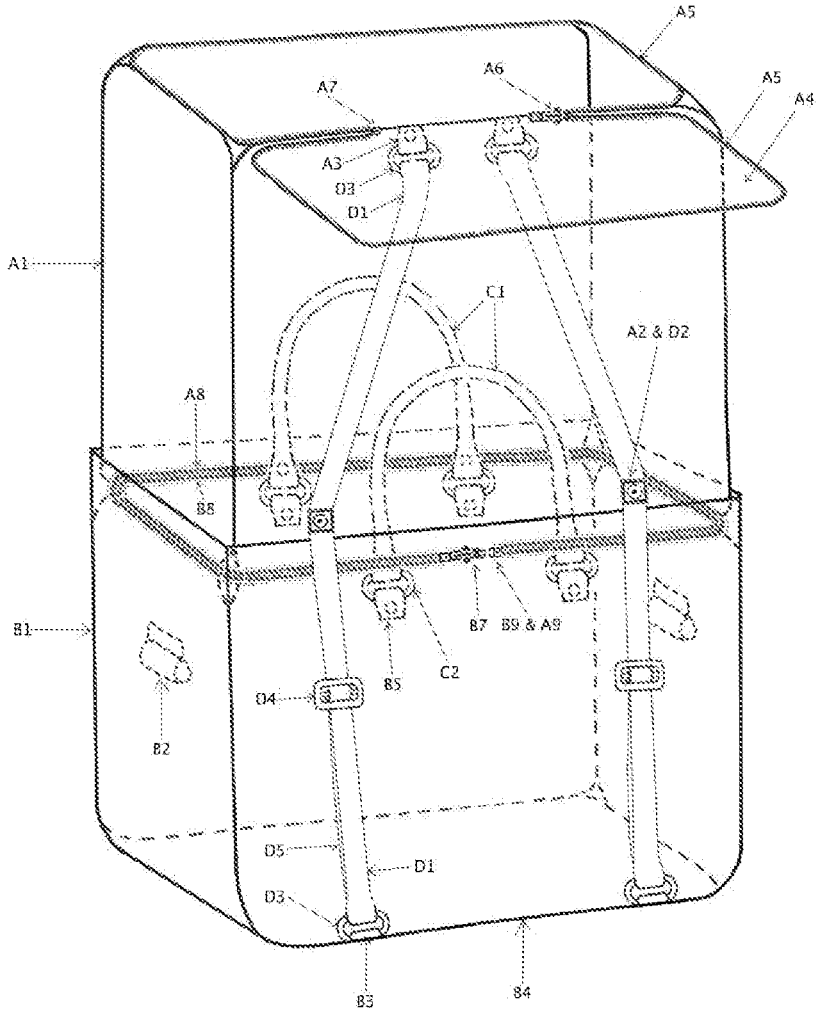
FIG. 3A is a complete perspective view of the one embodiment of the backpack system of the present invention with the top cover open and shoulder strap tightened, which is the first step to convert it into a handbag system; dotted lines showing the inside components that are not visible from outside the backpack system.
Figure 3B:
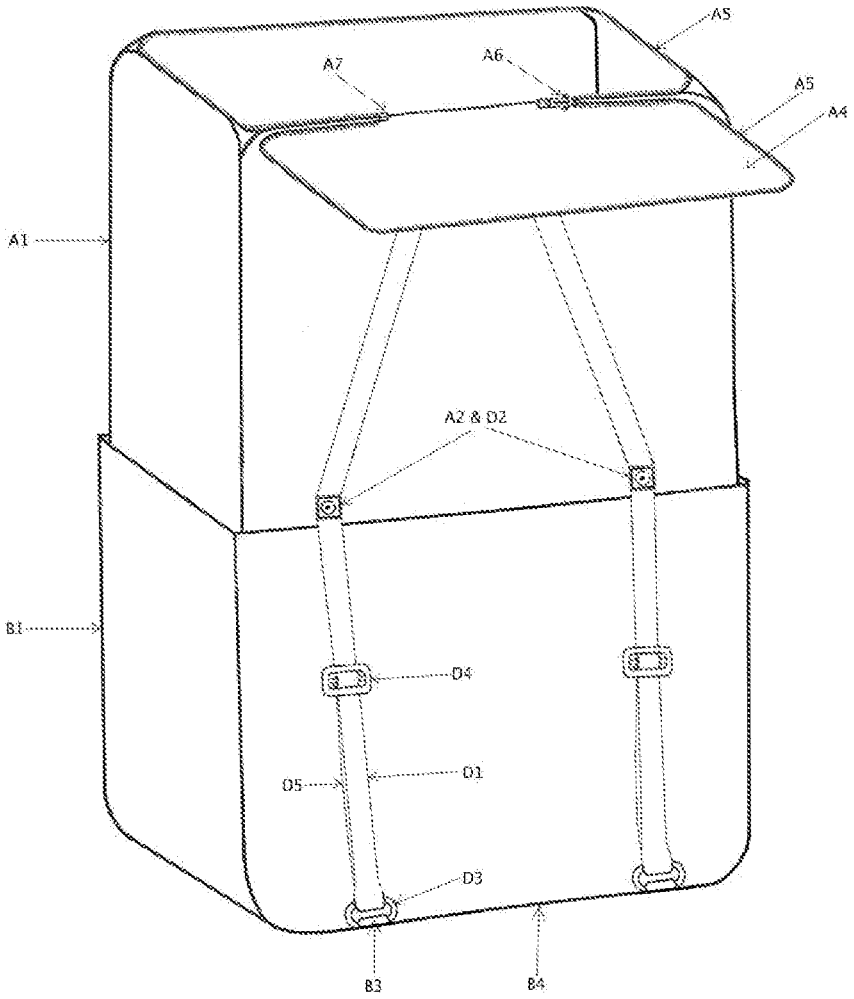
FIG. 3B is a perspective view of the one embodiment of the backpack system of the present invention with the top cover open and shoulder strap tightened, which is the first step to convert it into a handbag system.
Figure 4A:
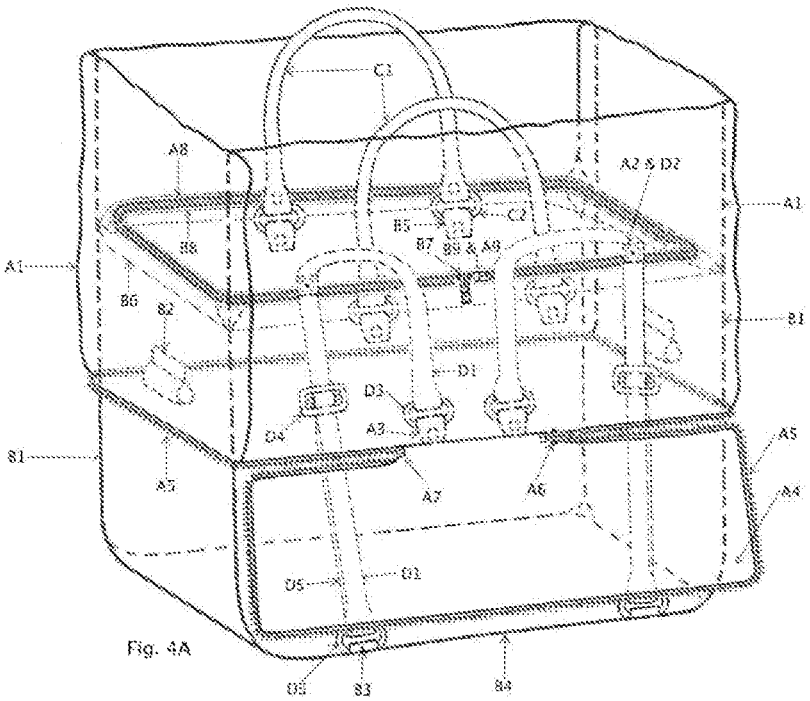
FIG. 4A is a complete perspective view of the one embodiment of the backpack system of the present invention during the second step to convert it into a handbag system; dotted lines showing the inside components that are not visible from outside the backpack system.
Figure 4B:
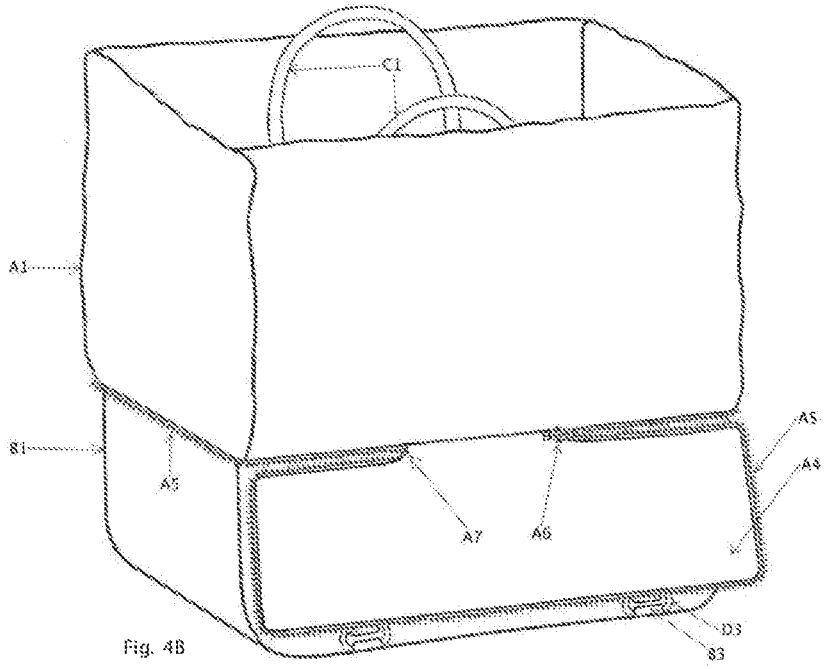
FIG. 4B is a perspective view of the one embodiment of the backpack system of the present invention during the second step to convert it into a handbag system.

The first step to convert the backpack system into a handbag, is shown in FIGS. 3A and 3B. During the conversion as a first step, the backpack user is to attach the back shoulder straps designated as D1 in FIGS. 3A and 3B to the top flipper body A1 by closing the buttons or any other fastener system designated as D2 on the back shoulder straps D1 with the buttons or any other fastener system A2 on the flipper body A1. Once the buttons or any other fastener system A2 and D2 are pressed together firmly, as shown in FIGS. 3A and 3B the back shoulder straps will stay attached to the backpack system embodiment. The length of the strap D1 can be adjusted to the length of the backpack system embodiment by moving the D4 buckle up or down. Once the straps are adjusted and attached to the backpack system embodiment as shown in FIGS. 3A and 3B, backpack user may open the top cover designated as A4 of the flipper body A1 by using the zipper A5. As shown in FIGS. 3A and 3B, Zipper slider A6 can be used to open the top cover A4.

Figure 5A:
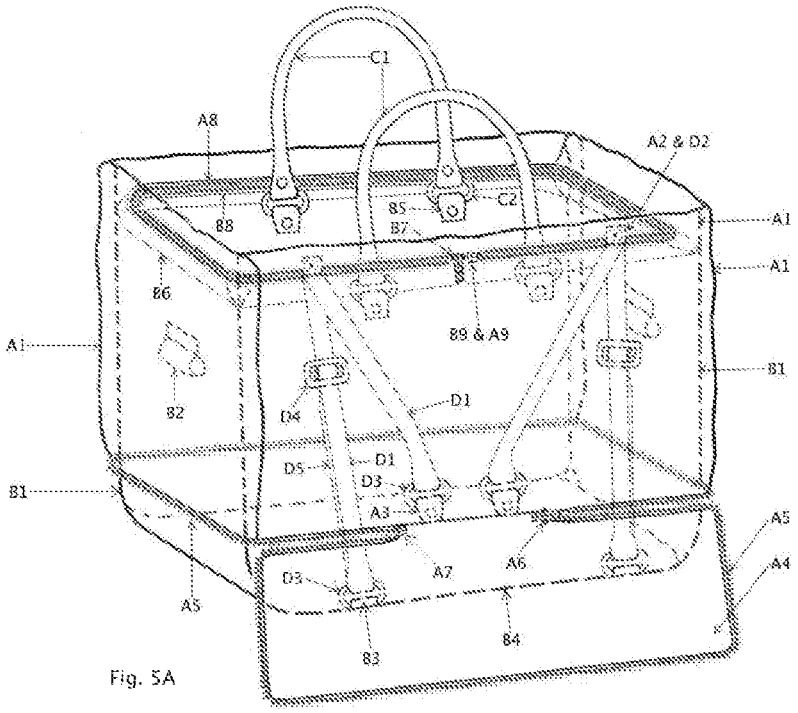
FIG. 5A is a complete perspective view of the one embodiment of the backpack system of the present invention during the third step to convert it into a handbag system; dotted lines showing the inside components that are not visible from outside the backpack system.
Figure 5B:
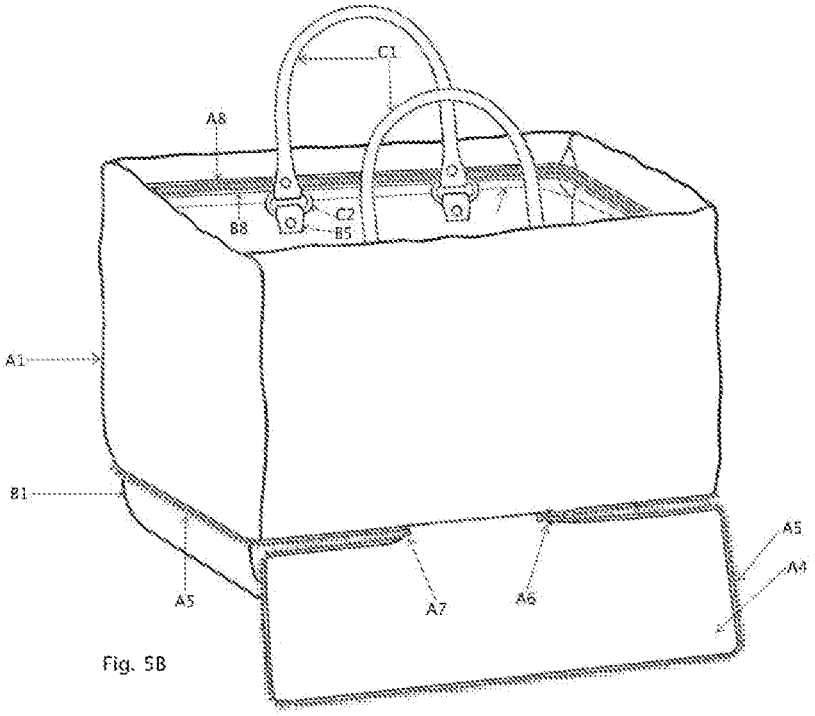
FIG. 5B is a perspective view of the one embodiment of the backpack system of the present invention during the third step to convert it into a handbag system.

The second step to convert the backpack system into a handbag, is shown in FIGS. 4A, 4B, 5A, and 5B. During the conversion as a second step, the backpack user is to fold down the top flipper body A1 from inside out. As shown in FIGS. 5A and 5B, the backpack system user will continue pulling down the flipper body component A1 down towards the bottom designated as B4 of the handbag body B1.

Figure 6A:
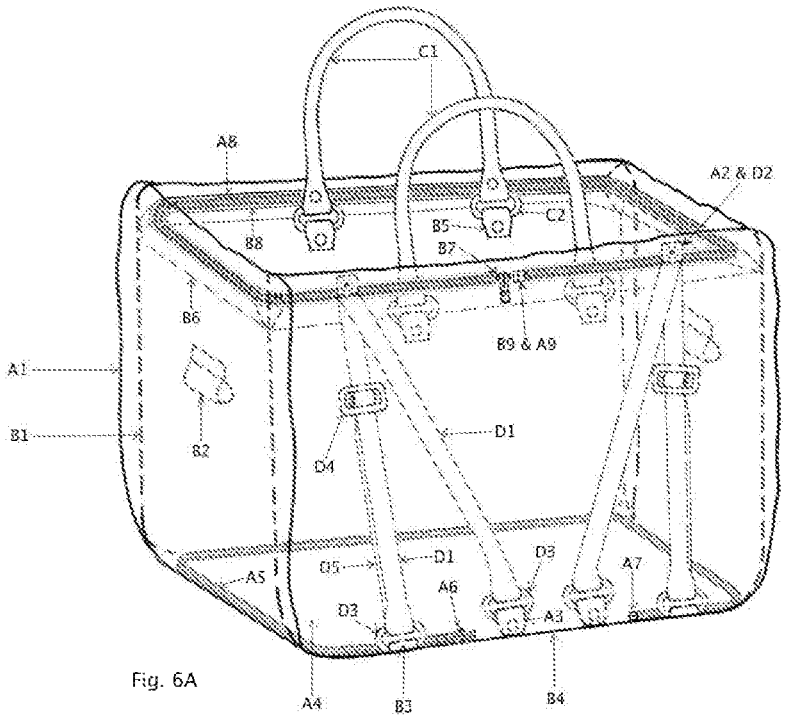
FIG. 6A is a complete perspective view of the one embodiment of the backpack system that is converted into a handbag system of the present invention; dotted lines showing the inside components that are not visible from outside the backpack system.
Figure 6B:
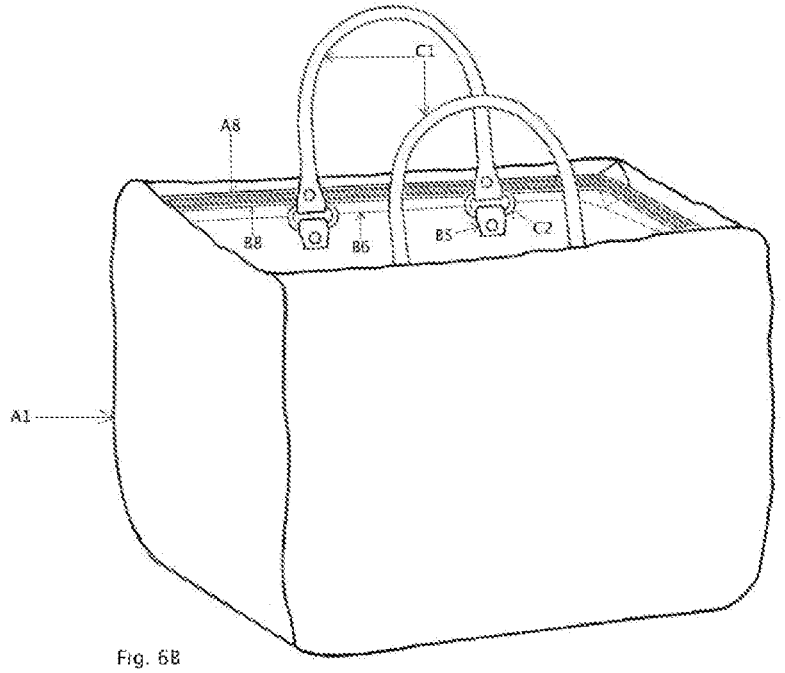
FIG. 6B is a perspective view of the one embodiment of the backpack system that is converted into a handbag system of the present invention.

The last step to convert the backpack system into a handbag, is shown in FIGS. 6A and 6B. During the conversion as the last step, the backpack user will use the zipper slider A6 to close the reversible zipper A5 at the bottom (B4) of the handbag body B1. Once the reversible zipper A5 is closed, the inner side of the flipper body A1 will cover the handbag body B1 entirely from all four sides conforming a different design of the handbag.

Figure 7A:
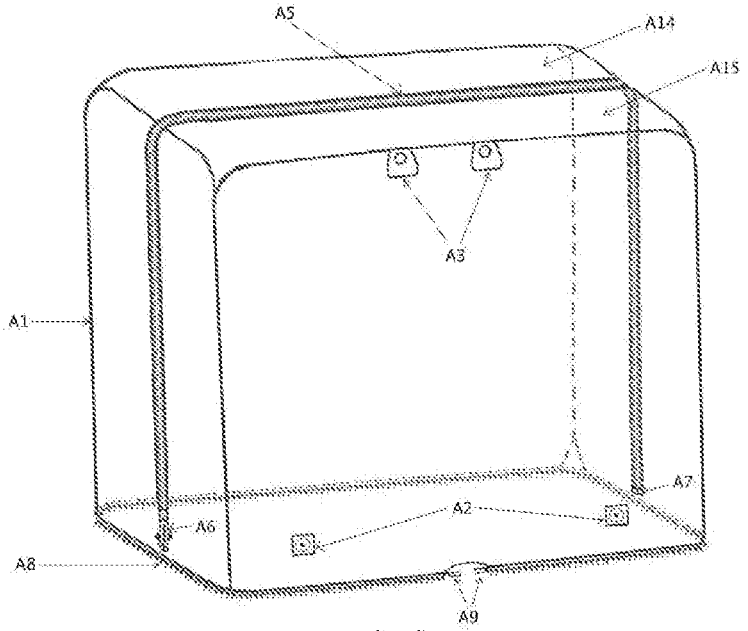
FIG. 7A-7B are complete perspective views of the different options of the one component of the backpack system of the present invention, which is exchanged with the top flipper body component shown in FIG. 1, and is combinable with the other components shown in FIG. 1.
Figure 7B:
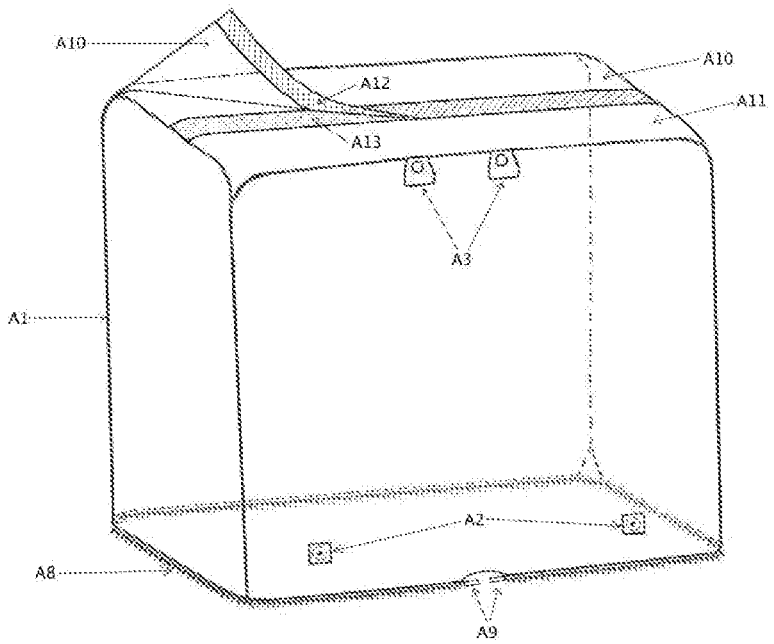
Figures 8A, 8B, 8C, 8D:
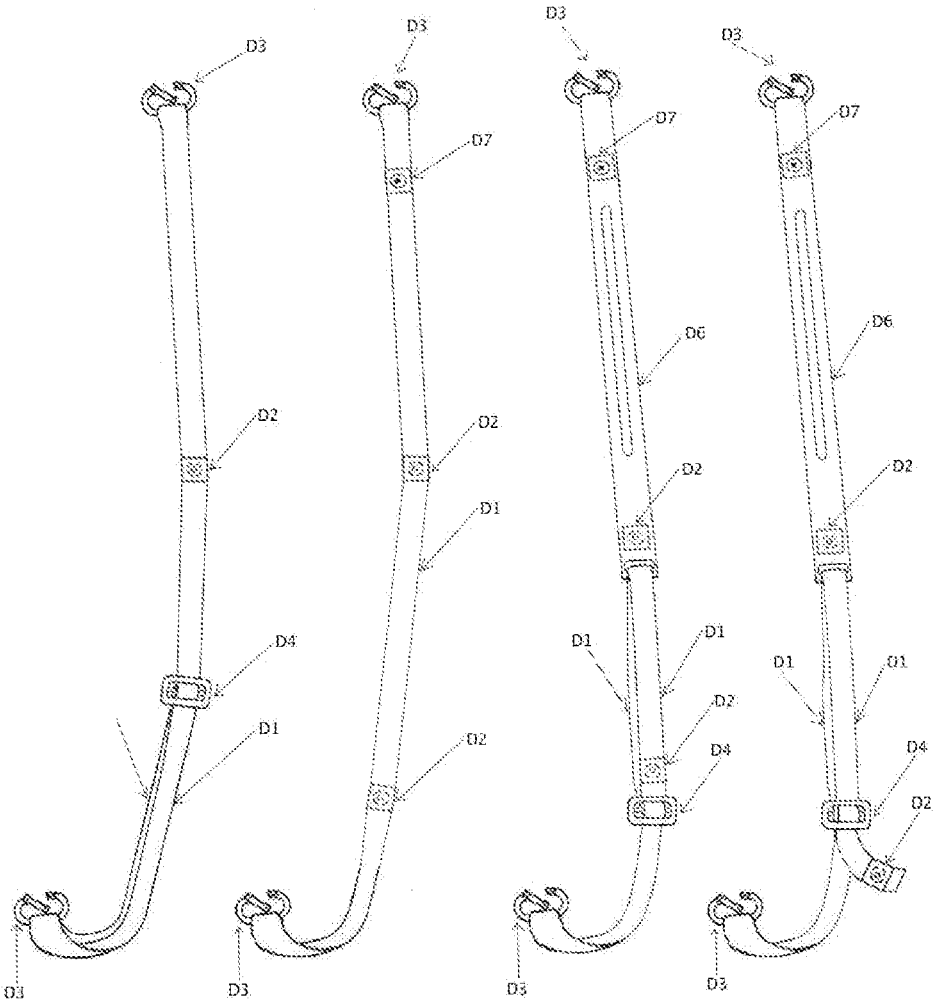
FIG. 8A-8D are perspective views of the different options of the one component of the backpack system of the present invention, which is exchanged with the back shoulder strap component shown in FIG. 1, and is combinable with the other components shown in FIG. 1.

As shown in FIGS. 7A and 7B, the flipper body component can be opened or closed from top with different mechanism using Velcro, Zipper or any other fastener system. Flipper bag body A1 as shown in FIG. 7A can be opened or closed using the zipper A5 by sliding the zipper slider A6 back and forth to zipper stop A7. Flipper bag body A1 shown in FIG. 7B can be opened or closed by using the Velcro (A12 and A13) attached to the cover A10 and A11. When using the top flipper body shown in FIG. 7A, the process to convert the backpack system into a handbag will be very similar except when closing the flipper cover A14 and A15 at the bottom. Reversible zipper A5 shown in FIG. 7A can be closed from one side of the handbag to the other side covering the handbag from the bottom for conversion. When using the top flipper body shown in FIG. 7B, the process to convert the backpack system into a handbag will be very similar except when closing the flipper cover A10 and A11 at the bottom of the handbag. Top Flipper cover A10 and A11 as shown in FIG. 7B can be closed from the bottom using the Velcro or any other fastener system.

FIGS. 8A, 8B, 8C, and 8D illustrates different mechanisms of the back shoulder straps the adjust the length of the strap as well as attaching it to the backpack system so it stays in place when converting the backpack system to handbag by folding down the flipper body over the handbag and closing the cover at the bottom of the handbag body. The back shoulder straps illustrated in FIGS. 8A, 8B, 8C, and 8D also shows different style and design for the means to carry the backpack system.

Using sturdy reversible or regular zipper is the preferred method or way of attaching or combining the flipper body component with the handbag body component in this configuration, although is not the only method or way of attaching or combining. Other forms of attachment or combining are possible by using snaps or snap buttons, press buttons, hook and loop fasteners, tabs and slots, Velcro fasten, and by any other conventional means of attaching or combining components such as these.

DEFINITIONS

A. Flipper/Flipper Body—is broadly defined as a detachable top body component by unzipping it from the bottom handbag component of the backpack system. Designated as A1 in FIG. 1.

B. Flipper Bag—is broadly defined as a backpack style bag that is created by attaching or combining a flipper body to a handbag. The complete backpack system shown in FIGS. 2A and 2B.

C. Handbag—Handbag for Men or Women. Designated as B1 in FIG. 1.

D. Backpack—Backpack system that can be carried on back shoulders. The complete backpack system shown in FIGS. 2A and 2B.

E. Back Shoulder Strap—is defined as a shoulder strap to carry the backpack system on users back. Designated as D1 in FIG. 1.

F. Zipper Chain—The continuous piece that is formed when both halves of a zipper are meshed together. Designated as A5 in FIG. 1.

G. Zipper Tape—The fabric part of the zipper. Designated as B6 in FIG. 1.

H. Zipper Slider—The device that moves up and down the chain to open or close the zipper. Designated as A6 and B7 in FIG. 1.

I. Zipper Pin—A device used on a separating (jacket type) zipper whose function is to allow the joining of the two zipper halves. Designated as A9 in FIG. 1.

J. Zipper Box—A device used on a separating (jacket type) zipper whose function is to correctly align the pin, to begin the joining of the zipper halves. Designated as B9 in FIG. 1.

K. Zipper Stop—Two devices affixed to the top or bottom end of a zipper, to prevent the slider from coming off the chain. Designated as A7 in FIG. 1.

L. Buckle—A metal or plastic ring with one spring-hinged side that is especially used as a connector to hold the handle and a connection loop together. Designated as D3 and C2 in FIG. 1.

M. Handbag Handles—is defined as handles specifically to carry the handbag of the present invention. Designated as C1 in FIG. 1.

N. Flipper Cover/Flipper Body Cover—is defined as a top cover of flipper body (Designated as A4 in FIG. 1. Also, Designated as A4 in FIGS. 3A and 3B) which fasten at upper edge of flipper body with fastener, using which flipper body can be open or close. It serves dual purpose. One, when in backpack mode, by opening or closing flipper cover user can access or secure contents of the bag respectively. Two, by opening or closing flipper cover user can unsecure or secure flipper on to bottom handbag body while converting to backpack or handbag respectively.

What is claimed is:

1. A backpack style bag for carrying articles that is convertible into a handbag configuration comprising:

a top flipper body having a first fastener side, said first fastener side at a lower end proximate to a lower edge of said top flipper body;

a bottom handbag body having a second fastener side, said second fastener side at an upper end proximate to an upper edge of the bottom handbag body, wherein said first fastener side and said second fastener side are fastened together and said bottom handbag body is capable of functioning independently of said top flipper body;

a top flipper body cover having a fastener thereon, said top flipper body cover adapted to open and close an open end of said top flipper body;

two handbag handles fastened to an interior side of said bottom handbag body below the second fastener side, wherein said handbag handles are adapted to carry the backpack style bag when it is converted into the handbag configuration;

two backpack shoulder straps, said backpack shoulder straps fastened at an upper end to an upper edge of said top flipper body, fastened at a lower end to a lower edge of said bottom handbag body and at a third fastener, between said lower end and said upper end, to a portion said top flipper body just above the first fastener side such that the backpack shoulder straps are secured to the top flipper body and bottom handbag body when the backpack style bag is being converted into the handbag configuration.

2. The backpack style bag claim 1, wherein the top flipper body is reversible.

3. The backpack style bag claim 1, wherein said first fastener side comprises a continuous half zipper or any other fastener mechanism.

4. The backpack style bag claim 1, wherein said second fastener side comprises a continuous half zipper or any other fastener mechanism.

5. The backpack style bag claim 1, wherein said top flipper body, said bottom handbag body, said backpack shoulder straps, and said handbag handles are formed from fabric, polyvinyl chloride, leather, manmade leather, or any other flexible or non-flexible material.

6. The backpack style bag claim 1, wherein said bottom handbag body is a complete autonomous handbag with said handbag handles affixed in the interior side of the said handbag body for carrying it as a handbag.

7. The backpack style bag claim 1, wherein said bottom handbag body is a complete autonomous shoulder bag wherein at least one of said backpack shoulder straps is capable of being affixed in the interior side of the said bottom handbag body for carrying it as a shoulder bag.

8. The backpack style bag claim 1, wherein the said backpack shoulder straps and the handbag handles are reversible to match the outside look of the bag.

9. The backpack style bag claim 1, wherein said top flipper body is capable of being turned inside out and pulled down over said bottom handbag body, whereby an interior side of said top flipper body covers an exterior side of said bottom handbag body, said top flipper cover is closed via said top flipper body cover fastener underneath the said bottom handbag body and said handbag handles extend from said bottom handbag body to carry said backpack style bag in said handbag configuration.

10. The backpack style bag claim 1, wherein said first fastener side and said second fastener side comprise any permanent or temporary fastener system.

11. The backpack style bag claim 1, wherein the said backpack style bag can be configured in a variety of shapes and sizes.

* * * * *